United States Patent [19]

Nicholson

[11] 4,088,800

[45] May 9, 1978

[54] METHOD FOR CLEANING AND RE-INKING PRINTER RIBBONS

[75] Inventor: Albert N. Nicholson, San Jose, Calif.

[73] Assignee: Computer Ribbon Systems, Inc., Santa Clara, Calif.

[21] Appl. No.: 676,504

[22] Filed: Apr. 13, 1976

Related U.S. Application Data

[63] Continuation-in-part of Ser. No. 648,182, Jan. 12, 1976, abandoned.

[51] Int. Cl.[2] ..... B41J 31/14

[52] U.S. Cl. ..... 427/8; 101/423; 427/10; 427/141; 427/299; 427/428; 427/429; 400/197; 400/202.4

[58] Field of Search ..... 427/8–10, 427/140, 141, 299, 428, 429; 156/94, 98; 197/171, 172; 101/416, 423, 348

[56] References Cited

U.S. PATENT DOCUMENTS

| | | | |
|---|---|---|---|
| 506,126 | 10/1893 | Lowe | 118/72 |
| 1,391,139 | 9/1921 | Ormes | 197/171 |
| 2,969,865 | 1/1961 | Long | 197/171 |
| 3,733,211 | 5/1973 | Anderson | 427/141 |
| 3,885,518 | 5/1975 | Varni | 118/6 |
| 3,948,382 | 4/1976 | Nesbitt et al. | 197/165 |

*Primary Examiner*—Thomas J. Herbert, Jr.
*Assistant Examiner*—Bruce H. Hess
*Attorney, Agent, or Firm*—Boone, Schatzel, Hamrick & Knudsen

[57] ABSTRACT

An apparatus for cleaning and re-inking a fibrous printer ribbon carried on first and second reels and having foreign matter thereon comprising a frame, first and second pairs of rotatable spindles mounted in the frame so as to define parallel axes and capable of holding the first and second reels, first and second motors for rotating the first and second pairs of spindles, an elongated inking roller rotatably mounted in the frame between and parallel to the axes for contacting and applying ink to the printer ribbon, a metering roller rotatably mounted in the frame parallel to the inking roller for metering ink onto the inking roller, a trough disposed beneath the inking roller for containing ink and providing such ink to the inking roller, a reservoir capable of holding ink for supplying ink to the trough, an elongated brush rotatably mounted in the frame intermediate the second pair of spindles and the metering roller for contacting, forcibly removing the foreign matter and opening the fibers of the ribbon, and a third motor for rotating the inking roller and for rotating the brush in an angular direction opposite to that of the inking roller and of the second pair of spindles when the ribbon is being accumulated on the first reel, whereby when the reels are held by the spindles and the first motor rotates the first pair of spindles in a direction such that the ribbon is accumulated on the first reel, the brush forcibly removes foreign matter from the ribbon and serves to clean and to open the fibers of the ribbon, and whereby continued rotation causes the inking roller to contact and apply ink to the cleaned ribbon, the ink serving to penetrate into the opened fibers of the ribbon.

6 Claims, 7 Drawing Figures

METHOD FOR CLEANING AND RE-INKING PRINTER RIBBONS

CROSS REFERENCE TO RELATED APPLICATION

This application is a continuation-in-part of application Ser. No. 648,182, filed Jan. 12, 1976 now abandoned, and the content of that application is expressly incorporated hereby by reference.

BACKGROUND OF THE INVENTION

1. Field of the Invention

The present invention relates generally to an apparatus and a method for cleaning and re-inking ribbons, and more particularly, to such apparatus employing a rotating brush for cleaning and treating a used printer ribbon prior to re-inking in such a manner as to extend the usable lifetime of the ribbon.

2. Description of the Prior Art

Heretofore, line printers such as those utilized in conjunction with computers and terminals in recent years have become widely used, not only as a tool for science and engineering, but also as a vital part of many business operations. Such line printers of the computer, terminal etc., type utilize ribbons, typically fabricated from nylon cloth, silk or the like as a source of ink for the original or top copy on the printer. Conventional computer printer ribbons of the type described are relatively expensive, and, for example, generally cost between $13 and $30. Such ribbons provide between 5 and 6 million lines of printing before the original ink supply is depleted. However, since today's line printers produce in excess of 1100 lines print per minute, the ribbons must be changed frequently where the printer is in continuous use. As a result of the high cost of new printer ribbons, machines have been developed for re-inking or rejuvenating used printer ribbons.

At present, the standard machine for re-inking printer ribbons is one manufactured by the Burroughs Corporation. This machine employs a mechanism for re-inking the ribbon that includes an ink roller in contact with a tray filled with ink, a metering roller mounted parallel to the inking roller for metering ink onto the inking roller and pressure roller mounted above the inking roller such that when the ribbon is disposed between the inking roller and the pressure roller the pressure roller is forced toward the inking roller causing ink to be applied to the ribbon. It has been found that the machine has a tendency to under-ink the ribbon. Hence, documents printed with such ribbons typically have a print quality that lacks the uniformity and degree of darkness necessary in most computer printout operations.

In addition to the above disadvantage, the machine does not employ any means for cleaning the used ribbon prior to re-inking or any mechanism for detecting defects, such as holes or thin spots in the ribbon. In this respect, when ribbons are not cleaned prior to being re-inked, dried ink, gum, lint, bits of paper, dirt, dust, and the like build up on the ribbon. This residue tends to flake off and carry with it the new ink supplied thereover which further deteriorates print quality. This becomes more of a problem when recycled paper is used to fabricate the printing paper.

Another device for re-inking a computer ribbon includes an ironing means for ironing and applying heat to a ribbon passing from a feed spindle to a take-up spindle before the ribbon is inked. This ironing means is relatively slow and complex and as a result, the device has not been accepted in the marketplace.

Yet another device for cleaning and re-inking a typewriter ribbon is a hand-operated one which includes two hand cranks, two rotatable brushes and an ink bath. The typewriter ribbon passes between the brushes which brush solid particles from the ribbon and down into the bath so as to become saturated with ink. Because of the size of the gears which drive the brushes, the brushes rotate at a much greater angular velocity than the cranks, thereby causing the dust, dirt and other solid foreign particles to be swept in front of the brushes. A disadvantage of the device is that the foreign particles may be reintroduced into the typewriter ribbon, either prior to or after re-inking. In addition, the device is hand-operated and does not employ any mechanism for metering the quantity of ink applied to the ribbon before such application. An example of such a device is found in U.S. Pat. No. 506,126, "Machine for Reinking Type Writer Ribbons," by J. M. Lowe.

Other examples of prior art re-inking apparatus are found in U.S. Pat. No. 3,731,649, "Ribbon-Inking Machine," by Frank R. Anderson and Albert J. Castro; and U.S. Pat. No. 3,885,518, "Ribbon-Inking Apparatus," by Anselm F. Varni. In addition, U.S. Pat. No. 2,956,300, "Web Tensioning and Cleaning Apparatus," by F. J. Bruno teaches a web tensioning and cleaning apparatus. None of these patents reveal that an apparatus capable of cleaning, re-inking, detecting holes in and aligning a printer ribbon.

SUMMARY OF THE INVENTION

It is therefore a primary object of the present invention to provide an automated apparatus for cleaning and re-inking a printer ribbon in a relatively short time.

Still another object of the present invention is to accomplish the previously stated object while being capable of detecting defects or holes in the printer ribbon so that the ribbon will not drop any printed character during operation.

Yet another object of the present invention is to provide such an apparatus that is simply constructed with snap-out elements, requires very little maintenance and extends the usable life of a computer ribbon by allowing such ribbons to be re-inked several times.

Briefly, the preferred embodiment includes a frame, first and second pairs of rotatable spindles mounted in the frame so as to define parallel axes and capable of holding first and second reels carrying a fibrous printer ribbon therebetween, first and second motors for selectively rotating an elongated inking roller rotatably mounted in the frame between and parallel to the axes for contacting and applying ink to the printer ribbon, a metering roller mounted in the frame parallel to the inking roller for metering ink onto the inking roller, a trough disposed beneath the inking roller for containing ink and providing such ink to the inking roller, a reservoir capable of holding ink for supplying ink to the trough, an elongated brush rotatably mounted in the frame intermediate the second pair of spindles and the metering roller for contacting, forcibly removing foreign matter and opening the fibers from the ribbon, a third motor for rotating the inking roller and for rotating the brush in an angular direction opposite to that of the inking roller and the second pair of spindles when the ribbon is being accumulated on the first reel, whereby when the reels are held by the spindles and the first motor rotates the first pair of spindles in a direction such that the ribbon is accumulated on the first reel, the brush forcibly removes foreign matter from the ribbon and serves to clean and to open the fibers of the ribbon, and whereby continued rotation causes the inking roller to contact and apply ink to the cleaned ribbon, the ink serving to penetrate into the opened fibers of the ribbon.

In addition, a hole detection system is employed for the purpose of detecting holes in the ribbon and stopping the operation of the apparatus so that the operator can observe the ribbon.

In another embodiment a method comprises the steps of providing first and second pairs of spindles for rotatably carrying first and second reels on which the ribbon is carried, aligning the ribbon on its reels, rotating the first pair of spindles such that the ribbon is caused to be accumulated on the first reel, brushing the ribbon so as to remove foreign matter therefrom and to improve its capability to retain ink, providing an ink roller having ink thereon, rotating the ink roller, and moving the ribbon over the ink roller after the ribbon has been brushed.

Among the important advantages of the present invention is that it provides cleaned and re-inked printer ribbons in a simple, economic and automated manner.

Another advantage of the present invention is that it is capable of detecting holes or thin worn spots in the ribbon and that it is capable of cleaning and re-inking a used printer ribbon in about 90 seconds.

Yet another advantage of the present invention is that the apparatus is simple in construction and is easily maintained.

These and other objects and advantages of the present invention will no doubt become apparent following a reading of the detailed description of the preferred embodiment which is illustrated in the several figures of the drawing.

IN THE DRAWING

DETAILED DESCRIPTION OF THE PREFERRED EMBODIMENT

Figure 1:
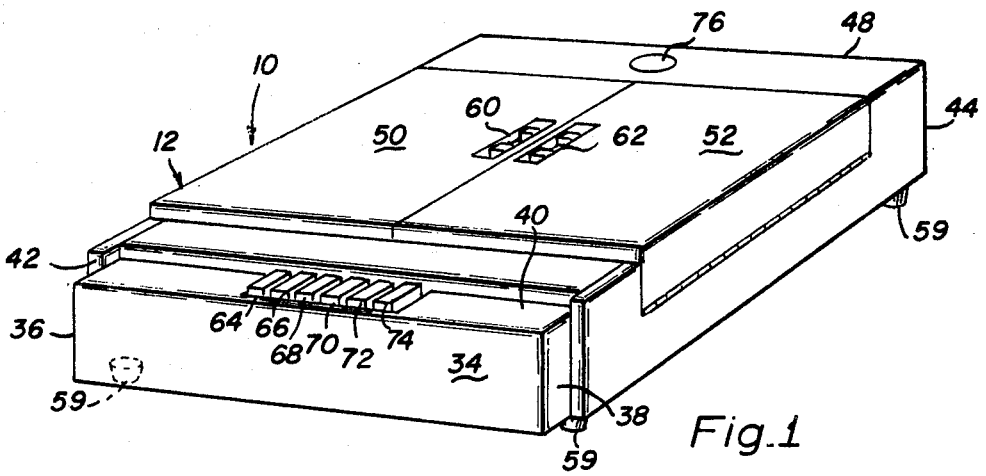
FIG. 1 is a perspective view of an apparatus for cleaning and re-inking a printer ribbon in accordance with the present invention.

Referring now to FIGS. 1–4 of the drawing, an apparatus for cleaning and for re-inking computer ribbons and the like in accordance with the present invention is illustrated in perspective and in front elevation views. As is shown therein, the apparatus 10 comprises a frame 12, two pairs of spindles 14 and 16, an inking system 18, a brush 20, end of ribbon sensing systems 22 and 24, and a hole detection system 26.

Figures 4, 6:
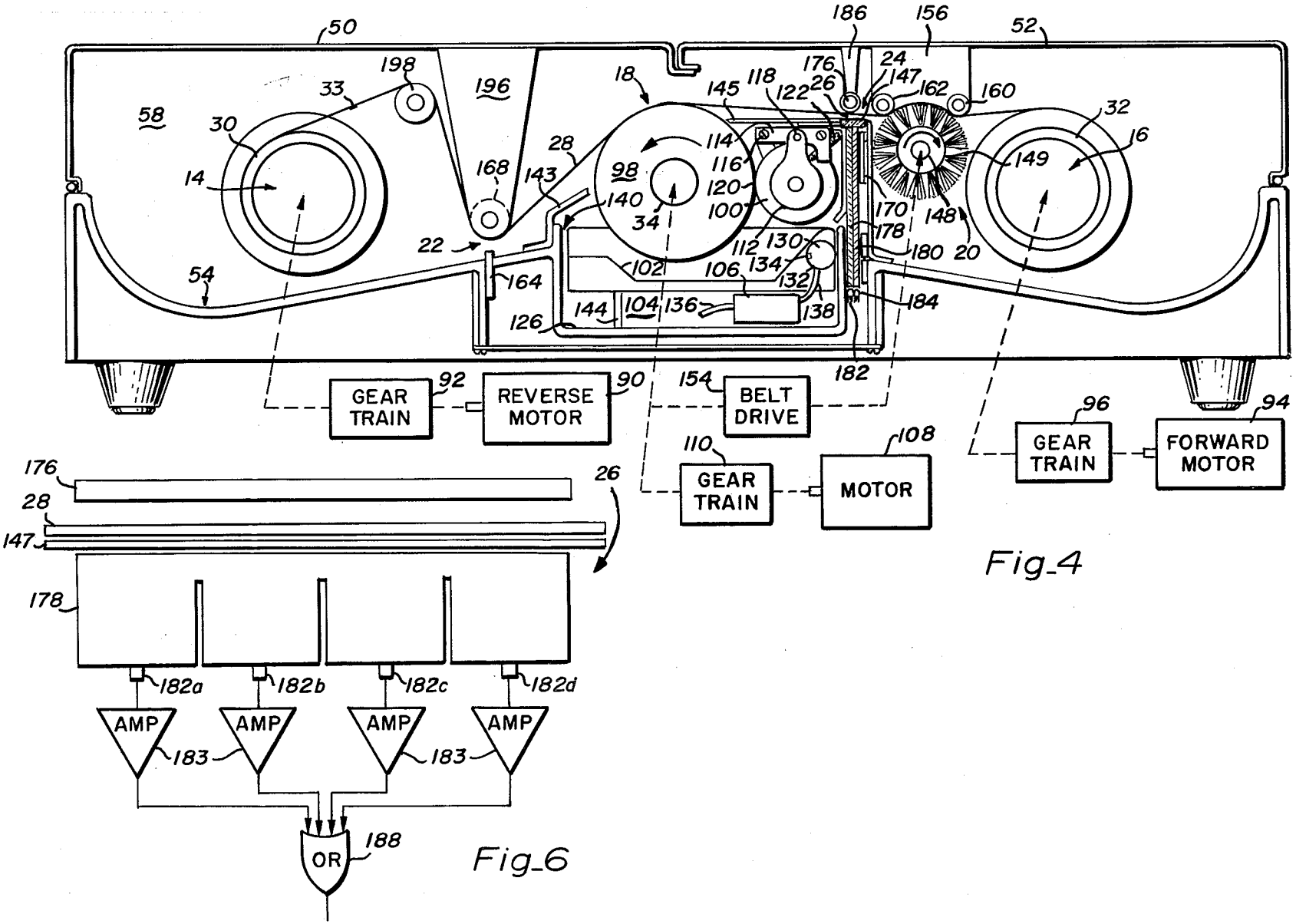
FIG. 4 is a schematic diagram illustrating a front elevation view of the interior of the apparatus, with the front panel removed.
FIG. 6 is a side elevation view of the hole detection assembly.

The ribbons 28 which are to be cleaned and re-inked by the apparatus 10 are generally wound between two elongated, hollow cylindrical mandrels or reels, 30 and 32 (see FIG. 4) Typically, such ribbons are formed from a woven, matted, fibrous, nylon fabric of substantial porosity, have a length of about 20 yards and include either metal reversing bars or strips of aluminum 33 extending across the width of the ribbon near its ends (only one of which is shown in FIG. 4).

Figure 2:
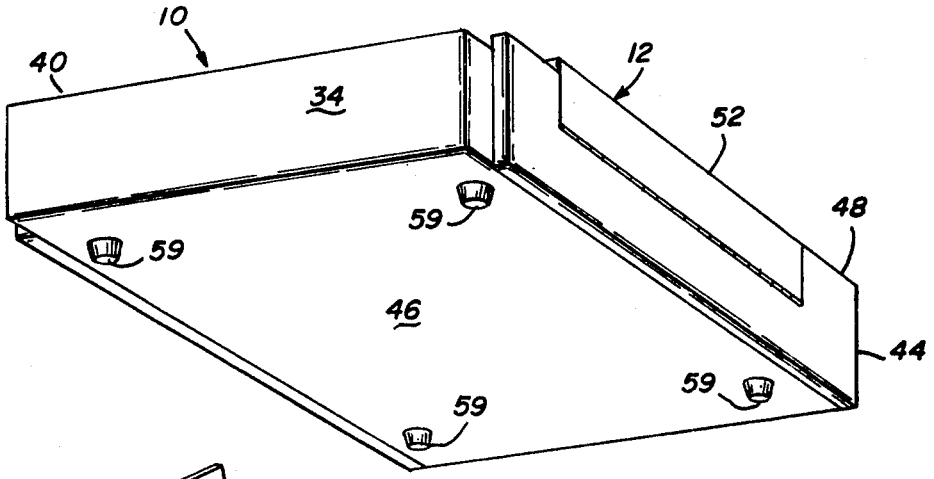
FIG. 2 is a second perspective view of the apparatus of FIG. 1 illustrating the front and bottom of such apparatus.
Figure 3:
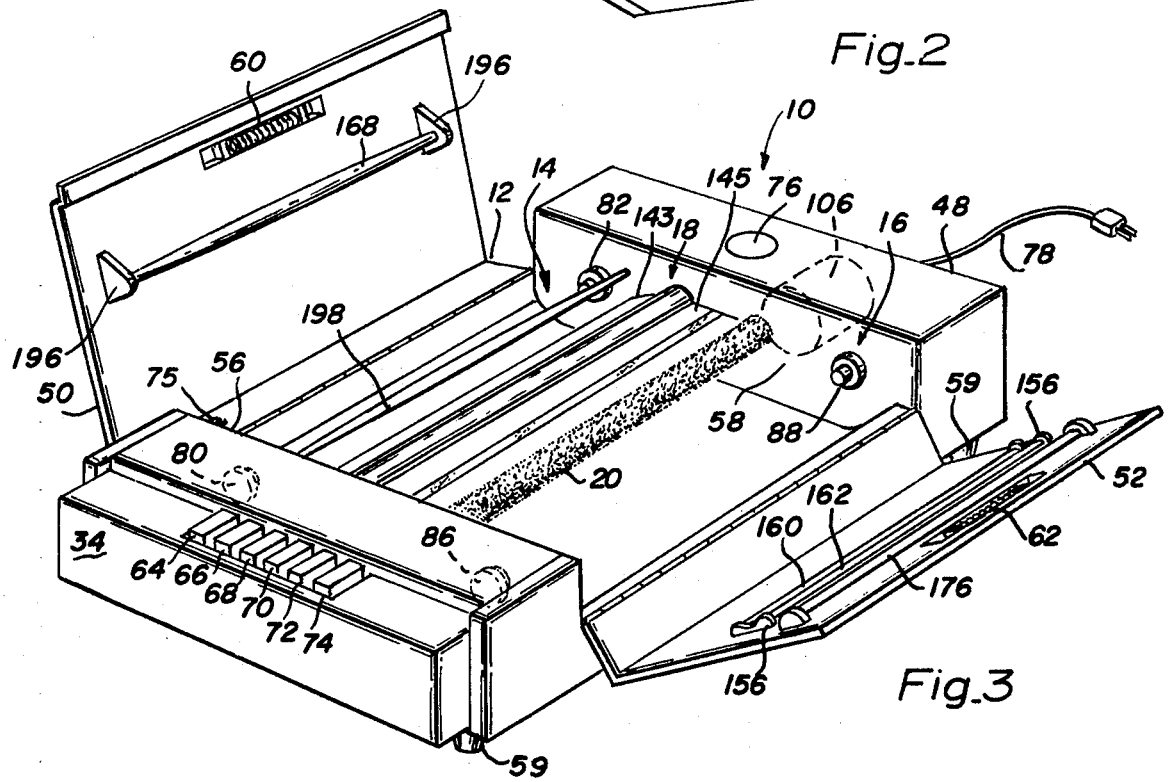
FIG. 3 is a perspective view similar to the view of FIG. 1 but with the cover opened to show the interior of the apparatus.

With reference particularly to FIGS. 1 and 2, the frame 12 is generally a box-like structure including a substantially rectangular front panel 34 having side surfaces 36 and 38, and a top surface 40, side panels 42 and 44, a bottom panel 46, a back panel 48, a top panel provided with doors 50 and 52 pivotally connected to the side panel 42 and 44, and a cast baseplate 54 including parallel walls 56 and 58, and feet 59. Spring-loaded latch assemblies 60 and 62 are formed in the doors 50 and 52, respectively, which serve to maintain the doors in a covering relationship such that the interior of the apparatus is light-free during its operation and to contain ink therein. Six push-button type switches 64–74 are provided on the top surface 40. The operation of the switches 64–74 will be described in detail hereinafter. An inkwell-filling port 76 is formed in the top surface of the back panel 48. Turning also to FIG. 3, a power cord 78 extends through the back panel 48 and serves to provide 120 volt AC voltage to the apparatus.

Figure 5:
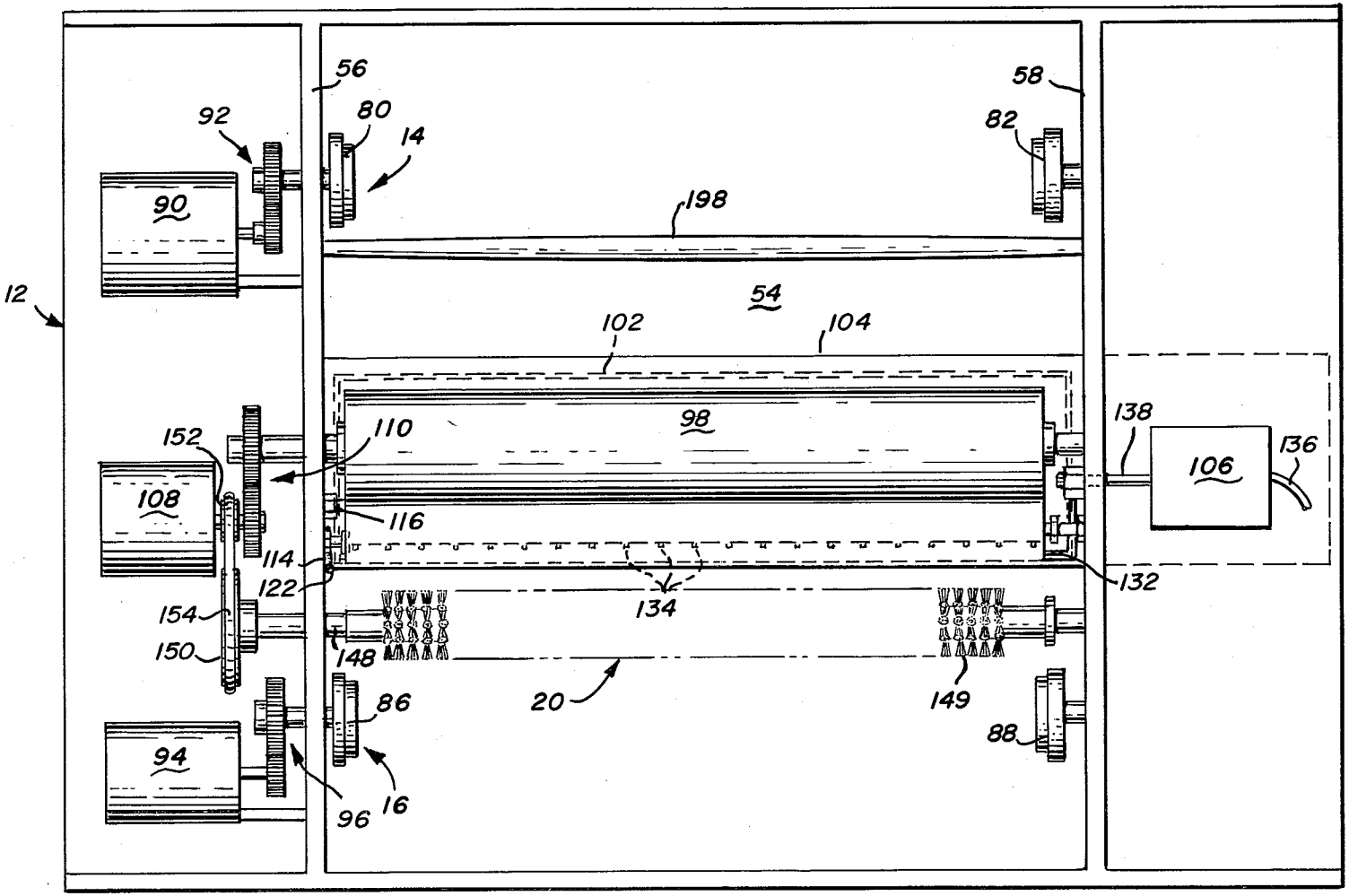
FIG. 5 is a plan view of the apparatus, with the top panel and doors removed.

The pair of take-up spindles 14 includes a spindle 80 rotatably mounted through the front wall 56 and a spindle 82 axially aligned with the spindle 80 and rotatably mounted through the back wall 58 in a spring-loaded arrangement. The spindles 80 and 82 are shaped to rigidly hold the reel 30 of the printer ribbon as will be understood by those skilled in the art. Similarly, the pair of rotatable feed spindles 16 includes a spindle 86 and a spring-loaded spindle 88 and serve to compressively hold the reel 32 in place. Referring also to FIGS. 4 and 5, a motor 90 disposed beneath the front panel 34 and rigidly mounted to the front wall 56 includes a rotatably shaft that is coupled to the spindle 80 by a gear train mechanism 92. The motor 90 is commonly referred to as reverse motor and serves to drive the spindle 80 in a counterclockwise direction. The motion of the spindle 80 is transmitted through the reel 30 to the spindle 82. In a similar manner a motor 94, commonly referred to as the forward motor, is coupled to the feed spindle 86 by a gear train 96 and serves to drive the spindle in a clockwise direction. The motors, gear trains, and spindles may be ordinary, commercially-available parts.

The inking system 18 comprises an ink roller 98, a metering roller 100, a tray 102, a reservoir 104, and a pump 106. The ink roller 98 is an elongated, cylindrical roller mounted on bearings between the walls 56 and 58. The ink roller 98 is driven by a motor 108 and gear train 110 as illustrated in FIG. 5. In the preferred embodiment the ink roller comprises an aluminum member covered by an outer shell of rubber.

The metering roller 100 comprises an elongated cylindrical metal member rotatably mounted on a shaft and having an end plate 112 affixed thereto. An L-shaped bracket 114 having an opening 115 is secured to the wall 56 by screws 116. A rivet or pin 118 extends through the bracket 114 and the distal end of the plate 112 and serves to pivotally mount the roller 110 to the frame so that the roller is coaxial with the ink roller 98 in a manner well known in the art.

A central portion 126 of the base plate 54 is recessed as shown in FIG. 4 to form a region capable of holding an ink. The tray 102 extending substantially between the walls 56 and 58 is formed to fit within the recess with its bottom surface and the central portion 126 forming the reservoir 104 and with its top surface below the ink roller 98 and the metering roller 100. Although not shown, a conduit extends from the port 76 to the reservoir 104 and permits the reservoir to be filled with ink as desired.

A generally cylindrical manifold 130 having an inlet 132 and outlet apertures 134 is mounted to a sidewall of the central portion 126 above the tray 102. The pump 106 is connected by conduit 136 to the reservoir and by conduit 138 to the inlet 132 and serves to continually pump ink contained within the reservoir to the manifold 130. The manifold 130 serves to provide ink through its outlets 134 to the tray 102. As shown in FIG. 4, a weir 140 is formed between the tray and a sidewall of the central portion 126 so as to provide a path for the ink that overflows the tray to reach the reservoir 104. A pair of shields 143 and 145 are secured to the opposed walls of the central portion of the base plate 54 and extend a length so as to be slightly out of contact with the rotating ink roller 98. The shields 143 and 145 serve to prevent ink from splashing out of the tray and entering the interior of the apparatus. The shield 145 includes a transparent window 147 for permitting light to enter the interior of the apparatus as will be subsequently described. A float switch 144, of the conventional commercially available reed-switch type, capable of sensing the quantity of ink in the reservoir is mounted to the bottom of the reservoir and is electrically connected to the low ink warning light 64 on the front panel which serves to provide a visual indication when the supply of ink falls below a predetermined level.

Accordingly, it is seen that the ink is pumped from the reservoir 104 to the manifold 136 and into the tray 102 where it comes in contact with the rotating ink roller 98. The quantity of ink on the roller 98 is metered by the setting of the set screw 122 on the rotating metering roller 100. Ink overflowing the tray 102 is conducted through the weir 140 into the reservoir and again recycled by the pump 106.

The brush 20 includes an elongated cylindrical shaft 148 journaled between the walls 56 and 58, and bristles 149. The shaft 148 has a pulley 150 affixed to its end within the front panel 34. The pulley 150 is in alignment with a pulley 152 disposed on the output shaft of the motor 108 and coupled thereto by a belt 154. Accordingly, the brush 20 is driven in a clockwise direction, opposite to the direction of rotation of the ink roller 98. In the preferred embodiment the relative diameter of the pulleys 150 and 152 are such that the angular rotation of the brush is about 20 rpm whereas that of the ink roller is about 60 rpm.

The bristles 149 extend radially outwardly from the shaft 148 and are formed from a relatively stiff pile-like material. In the preferred embodiment the bristles are comprised of number 10 nylon and have a length of inches. The bristles 149 serve to pick and penetrate the fibrous surface of the printer ribbon 28 when it is brought into contact with and moved relatively to the ribbon in a manner so as to remove the foreign matter, such as dirt, lint, paper chaff, etc., from the ribbon. In addition to this cleaning action, the penetration of the bristles into the ribbon opens the matted fibers of the ribbon and hence, enables ink, when supplied to the ribbon, to readily penetrate into the body of the ribbon with a substantially equal distribution. The length of the bristles is sufficient to retain the foreign matter that is removed from the ribbon. When desired, the foreign matter accumulated in the bristles may be removed by combing.

It should be noted that bristles having a length of ½ inches have been found to be too brittle and are able to retain the foreign matter, and bristles having a length of 1 inch have been found to be too soft relative to achieving the optimum cleaning and re-inking characteristics of the apparatus.

A pair of brackets 156 are mounted to the bottom surface of the door 52. Two idler rollers 160 and 162 are rotatably mounted between the brackets 156 such that when the door 52 is closed the rollers depress the bristles 159 at locations subtending an arc of about 60° relative to the axis of the brush 20. Accordingly, the idler rollers 160 and 162 serve to force the ribbon against the tips of the bristles 149, resulting in a more efficient removal of the foreign matter that is embedded in the ribbon.

In order to understand the operation of the inking system 18 and the brush 20, it is assumed that the ribbon 28 is being wound on the reel 30 and is thus being drawn from the right to the left between the idler rollers 160 and 162 and the bristles 149, and that the motor 108 is driving the shaft 148 of the brush 20 in a clockwise direction opposite to the flow of the ribbon and is driving the inking roller 98 in a counterclockwise direction (in the direction of the motion of the ribbon). The idler rollers 160 and 162 are separated by about 60° and thus force the ribbon 28 wrapped over such wrap angle into the bristles 149. The bristles 149 rotating against the flow of the ribbon serve to forcibly remove by a "picking-type" action foreign matter, such as dirt, dried ink, paper chaff, etc., that is carried on the surface or embedded in the ribbon. Such bristles 149 are stiff enough to achieve this picking effect yet are soft enough to retain the foreign matter without damaging the ribbon. It has been found that maintaining the angular velocity of the brush to a rate such that its linear velocity at the tips of the bristles is much less than the velocity of the ribbon results in an improved cleaning action of the ribbon. Simultaneous with the removal of the foreign matter, the bristles also serve to open the pores of the ribbon in such a manner that in the subsequent re-inking operation, the ribbon is able to absorb relatively great quantities of ink. The cleaned ribbon then passes to the inking roller 98 which is rotating in a counterclockwise direction at a rate such that the linear velocity of its outer periphery is substantially equal to the velocity of the ribbon in contact with such periphery. This assures that fresh ink is applied evenly to all portions of the ribbon during the re-inking operation.

Referring again to FIGS. 4 and 7, the end of ribbon sensing system 22 includes a photo-optical detector 164 and an amplifier 166. The detector 164 incorporates a light emitting diode and a light detecting diode in a circuit of the conventional type such that the light emitting diode emits a beam of light focused at a preselected point. The light detecting diode exhibits a resistance change when it is struck by light reflected off an object passing through the preselected point. The detector 164 is mounted to the base plate 54 near the wall 56 by a conventional mounting fixture below a crown roller 168 such that the beam impinges the printer ribbon 28 as the ribbon travels from the spindles 16 to the spindles 14. Normally, with the ribbon passing above the detector very little light is reflected toward the detector so that the output signal of the circuit is at a low level. However, when the metal bar or strip 33 passes above the detector 164, it causes sufficient light reflection to cause the level of the output signal of the circuit to change. This change is amplified by the amplifier 166 and results in a signal that serves to shut off the motor 90, thereby stopping the movement of the ribbon. In a preferred embodiment, the detector 164 is one manufactured by the Optron Company and designated by them as the Model OPB125, and the end of ribbon sensing system 22 employs a second photo-optical detector **164*a* and amplifier 166*a* mounted near the wall 58 to further provide against malfunction of the end of ribbon sensing operation. An OR gate 169 serves to conduct the signals from the amplifiers 166 and 166*a*** to the reverse relay circuit as will be subsequently described.

In a similar manner, the sensing system 24 includes photooptical detectors 170 and **170*a*, and amplifiers 172 and 172*a* mounted to the baseplate adjacent the walls 56 and 58, respectively, and below the path of the ribbon. An OR gate 173 serves to conduct the output signals from the amplifiers 172 and 172*a* to the run relay circuit in a manner as will be subsequently described. The system 24 serves to detect the metal bar, and hence the end of ribbon, as the ribbon is being wound to the reel 32 and responds by deenergizing the motor 94**.

Figure 7:
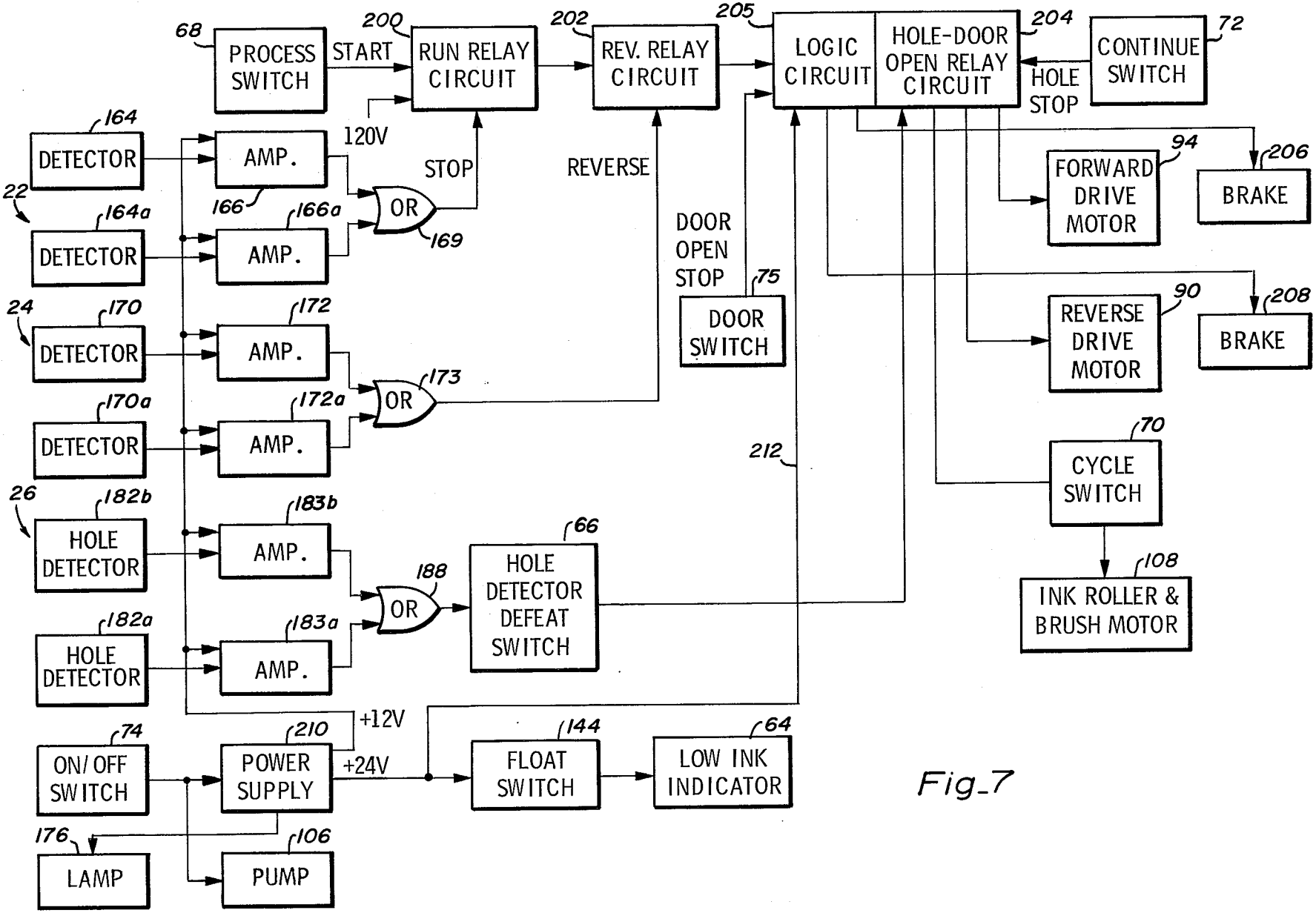
FIG. 7 is a schematic diagram in block form generally illustrating the principal components of the electrical system of the apparatus shown in FIG. 1.

Turning also to FIG. 6 the hole detection system 26 includes a lamp 176, two sheets 178 and 180 formed of a material that conducts visible light, and eight light detectors **182*a–d* and 184*a–d*. For purposes of simplicity, only one of the sheets and four of the detectors are shown in FIG. 6. The lamp 176 is an elongated bulb that produces a white light of relatively low intensity across the width of the ribbon. The lamp 176 is mounted by a pair of brackets 186 to the bottom surface of the door 52 so that when the door 52 is closed and a ribbon is on the spindles 14 and 16, the lamp is slightly above the ribbon 28 and in alignment with the transparent window 147 formed in the ink shield 145. The sheet 178 is mounted to the ink shield 145 by a conventional mounting element (not shown) and is formed from a plastic material, such as Plexiglas, to have four separated collector regions. The sheet 178 serves to conduct light passing through the ribbon and the window 147 to the subjacent collector region. In the preferred embodiment, an aluminum-backed tape having a black outer surface is adhered to each of the lateral surfaces of the sheet. The tape serves to reflect light which strikes it. Hence, the light entering the sheet from the lamp is reflected off the surfaces of the sheet and thus contained within the sheet in such a manner that attenuation is minimized. The detectors 182*a–d*, each having respective output leads connected to amplifiers 182 (only two of which are shown in FIG. 7) are mounted beneath a respective light collecting region of the sheet 178 and serve to provide an electrical signal in response to the light. An OR gate 188 is connected to the output of the amplifiers 183 and provides a signal when an output appears on any of the output leads of the detectors 182*1–d*. The hole detector defeat switch 66 located on the front panel 34 is connected between the output of the OR gate 188 and the hole-door open relay circuit. The switch 66 is utilized to permit operation of the apparatus with the doors 50 and 52 open and to permit reinking without checking for holes and serves to disable the hole detection system 96** from operation.

The sheet 180 and detectors **184*a–d* are identical in construction and operation to the sheet 178 and the detectors 182*a–d* and serve as a redundant hole detection system in case of a malfunction of the detectors 182*a–d***.

In operation, when the ribbon is being inked by the apparatus, holes or thin spots in the ribbon having a diameter of about 0.050 inches are capable of being detected by the hole detection system. It should be recognized that holes of such a size correspond to that of a printed period at the end of a sentence, which is the smallest of all the printed characters. As will be subsequently described, when a hole is detected the apparatus is cause to stop operation so as to enable the ribbon to be inspected by the operator.

During usage a printer ribbon commonly becomes skewed as it is wound and rewound on the printer. Consequently, ribbons that are to be re-inked typically must be reoriented or realigned on their reels before they can be re-inked.

Another feature of the present invention is its capability to automatically align a printer ribbon on its reels. In order to accomplish this feature, the crown roller 168 is rotatably mounted on brackets 196 to the bottom surface of the door 50 in a manner so that it extends into the interior as illustrated in FIG. 4, when the door is closed. A crown roller 198 mounted intermediate the spindles 80 and 82 and the crown roller 168 is similarly rotatably mounted between the front and back walls 56 and 58 in such manner that the ribbon 28 when threaded over the crown roller 168 has a wrap of about 90° and when threaded over the crown roller 198 has a wrap of about 90° and lies in a plane when passing between the crown rollers 168 and 198 that forms a small angle relative to the side panels 42 and 44. The crown rollers 168 and 198 are appropriately journalled so as to be freely rotatable. It has been found that by positioning crown rollers 168 and 198 as described, the crown rollers serve to self-align the ribbon on its reels when the spindles are driven by the motors 90 and 94.

With reference also to FIG. 4, the ribbon 28 is shown positioned in the apparatus 10. As shown, the reel 30 is positioned on the pair of spindles 14, the reel 32 is positioned on the pair of spindles 16, and the ribbon 28 is wound over the crown roller 198, under the crown roller 168, over the outer periphery of the ink roller 98, between the lamp 176 and the top surface of the ink shield 145, under the idler 162, over the top surface of the brush 20 and under the idler 160.

Operation of the apparatus 10 is best understood with reference to FIG. 7 which illustrates in block diagram for the principal components of the electrical system. As shown, the electrical system includes the switches 64–75, a run relay circuit 200, a reverse relay circuit 202, a hole-door open relay circuit 204, the forward motor 94, the reverse motor 90, brakes 206 and 208 for stopping the rotation of the forward and reverse motors, respectively, the motor 108 for energizing the ink roller and the brush, the end of ribbon sensing systems 22 and 24, and the hole detection system 26.

The run relay circuit 200 is of a conventional type and includes a coil, switches, contacts, etc., for selectively energizing the reverse relay circuit 202 with the 120 volt source voltage. The run relay circuit 200 is actuated by depression of the process switch 68 on the front panel 34 and is deactivated upon the application of an electrical signal produced by the end of ribbon sensing system 24.

The reverse relay circuit 202 is of a similar construction as the run relay circuit and serves to supply power to the hole-door open relay circuit 204, in response to energization by the run relay circuit or to an electrical signal from the end of ribbon sensing system 22.

The hole-door open relay circuit 204 includes a coil, switches, contacts, and a logic circuit 205 that is responsive to the application of a 24-volt DC signal and operative to apply a control signal to the brakes 206 and 208 for the forward and reverse motors. The relay circuit 204 serves to supply energy to the motors 90, 94 and 108 in response to signals from the reverse relay circuit 202 or from the hole detection system 26. The cycle switch 70 located on the front panel 34 is connected between the hole-door open relay circuit 204 and the motor 108 and permits the motor 108 to be deenergized, which in turn stops the rotation of the ink roller 98 and the brush 20. This allows the ribbon to be cycled through the apparatus without being inked. A continue switch 72 is connected to the hole-door open relay circuit 204 and enables the circuit to be reenergized in such situations after it had been stopped due to the detection of a hole in a ribbon.

The on-off switch 74 is connected in an alternating current power line 78 and serves to supply AC voltage to the pump 106 and to a power supply 210. The power supply 210 develops a 12-volt regulated DC voltage and applies such voltage to the amplifiers 172, **172*a*, 166, 166*a*, 183*a* and 183*b*, and to the lamp 176. The power supply 210 also develops a 24-volt regulated DC voltage and applies such voltage to the float switch 144 and through a conductor 212 to the hole-door open relay circuit 204. The low ink indicator light 64 is serially connected to the float switch 144 and provides a visual indication on the panel face 34** when the ink supply is low.

The door switch 75 is an interlock type of device connected to the hole-door open relay circuit 204 and mounted for actuation by the door 50 when the door is closed. The door switch 75 enables the hole detector system 26 to be overriden when the door 52 is left open. This permits the ribbon and the operation of the apparatus to be observed by the operator as desired.

In operation, assuming the ribbon 28 is positioned in the apparatus 10 with its reels 30 and 32 on the pairs of spindles 14 and 16, respectively, and the doors 50 and 52 closed, the on-off switch 74 is depressed, thereby turning on the pump 106 which pumps ink into the manifold 130, the tray 102 and hence to the inking roller 98 in a manner as previously described, and, in addition, causing the power supply 210 to develop and apply regulated DC voltages to the amplifiers, lamp 176, float switch 144 and the hole-door open relay circuit 204. Next, the process switch 68 is depressed energizing the run relay circuit 200 and in turn the reverse relay circuit 202 and the hole-door open relay circuit 204. This deenergizes the brakes 206 and 208, and serves to reset the hole detector circuit 26. Accordingly, the forward motor 94 is energized which drives the pair of spindles 16 in a clockwise direction, causing the ribbon 28 to be accumulated on the reel 32. During this mode the hole detection system 26, although reset, is disabled.

When the metal bar or strip 33 passes over the end of ribbon sensing system 24, it causes a resistance change in the light detecting diode of the detector circuit 170 which in turn produces an output signal that is amplified in such system and applied to the reverse relay circuit 202. In response to the output signal the reverse relay circuit 202 is energized, which deenergizes the forward motor 94 and energizes the reverse motor 90 and the ink roller and brush motor 108 through the hole-door open relay circuit 204. Consequently, the pair of spindles 14 rotates in a counterclockwise direction, and pulls the ribbon 28 in a right-to-left direction through the apparatus with respect to the orientation shown in FIG. 4 so that the ribbon accumulates on the reel 30. Simultaneously, the activation of the motor 108 causes the brush 20 to rotate in a clockwise direction and the inking roller 98 to rotate in a counterclockwise direction. As the ribbon 28 is pulled over the bristles 149 and held firmly against it by the action of the idler rollers 160 and 162, foreign matter such as dried ink, dirt, lint, paper chaff and the like are picked from the ribbon by the bristles, thereby cleaning the ribbon as previously described. Subsequent passage of the cleaned ribbon over the rotating ink roller 98 causes ink to be applied to the ribbon. Since the bristles 149 penetrate and open the matted fibers of the ribbon 28, ink is readily received by the ribbon.

In the preferred embodiment, the speed of the ribbon is substantially equal to that of the linear speed of the ink roller at its outer inking periphery. In this manner the ink roller is able to provide a continuous supply of ink to the ribbon.

In this mode, the hole detector circuit 26 is enabled. Hence, if the door 52 is opened or if the hole detector 182 detects a hole, then a signal is developed by the detector 182 which is amplified by the amplifier 183 and supplied to the hole-door open relay circuit 204. In response to such a signal the circuit 204 deenergizes the reverse motor 90 and the motor 108, and applies a braking voltage to the brakes 206 and 208, thus stopping the forward and the reverse motors. In this condition the operator can then open the door 52 and observe the defect. After the operator has inspected the ribbon and determined that re-inking of the ribbon should continue, the continue switch 72 is depressed which resets the brakes 206 and 208, and the hole-door open relay circuit allows the re-inking operation to continue.

When the ribbon is substantially accumulated on the reel 30 and the metal bar passes the end of ribbon sensing system 22, the detectors 164 and **164*a* develop an electrical signal which is amplified by the amplifiers 166 conducted through the OR gate 169 and applied to the run relay circuit 200. This deenergizes the circuits 200, 202 and 204 thereby deenergizing the motors 90 and 108**.

It should be noted that if desired the hole detector defeat switch 66 coupled between the OR gate 188 and the hole-door open relay circuit 204 permits the hole detecting system 26 to be disconnected from the circuit. This allows ribbons to be re-inked without checking them for holes.

By depressing the cycle switch 70 the motor 108 can be deenergized, stopping rotation of the ink roller 98 and the brush 20. Consequently, ink is not supplied to the stationary ink roller. This permits the ribbon to accumulate on the reel 30 without having the ribbon inked. In this manner, the ribbon can be run back and forth through the apparatus over the crown rollers 168 and 198 until its edges are aligned. The cycle mode is typically required for many of the ribbons that are supplied for refurbishing.

From the above, it will be seen that there has been provided an apparatus and a method for cleaning and reinking a printer ribbon which fulfills all of the objects and advantages set forth above.

While the invention has been particularly shown and described with reference to a certain preferred embodiment, it will be understood by those skilled in the art that various alterations and modifications in form and detail may be made therein without departing from the invention. Accordingly, it is intended that the following claims cover all such alterations and modifications as fall within the true spirit and scope of the invention.

What is claimed is:

1. A method for cleaning and re-inking a printer ribbon carried on first and second reels comprising:
   - providing first and second pairs of spindles for rotatably carrying the first and second reels, respectively;
   - rotating the first pair of spindles such that the ribbon is cause to be accumulated on the first reel;
   - providing a rotating brush having a length at least as wide as the ribbon width;
   - passing the ribbon across the brush in a direction opposite to its rotation so that the brush engages the ribbon and removes foreign matter therefrom;
   - providing a sensing means capable of sensing holes in the ribbon, and sensing means including
     - a source of light positioned adjacent the path of one surface of the moving ribbon such that a beam of light from the source is directed against said one surface, and
     - a light detector positioned adjacent the opposite surface of the moving ribbon so that any holes in the ribbon allow light from the source to reach said detector; passing the brushed ribbon across the sensing means;
   - stopping the rotation of said spindles when the light detector senses light passing through a hole in the ribbon;
   - providing an inking roller having ink thereon;
   - passing the brushed ribbon in contact with said inking roller if no holes are detected so that ink is transferred from said inking roller to said ribbon; and
   - rotating said second pair of spindles so that the inked ribbon is wound about said second reel.

2. A method for cleaning and re-inking a printer ribbon as recited in claim 1 wherein the first pair of spindles and the inking roller are rotated at angular velocities such that linear velocity of the moving ribbon and the linear velocity of the inking roller at its outer periphery are substantially equal.

3. A method for cleaning and re-inking a printer ribbon as recited in claim 1 wherein the inking roller is rotated at an angular velocity that is about three times the angular velocity of the brush.

4. A method for cleaning and re-inking a printer ribbon as recited in claim 1 and further comprising:
   - providing an ink reservoir, a pump, a manifold and a tray;
   - pumping ink from the reservoir to the manifold;
   - dispensing ink from the manifold to the tray in generally equal quantities across the width of the tray; and
   - rotating the inking roller above the tray and in contact with the ink in the tray so that the ink is transferred from the tray to the surface of the roller.

5. A method for cleaning and re-inking a printer ribbon as recited in claim 1 and further comprising the steps of:
   - providing a crowned roller in the path of the ribbon; and
   - moving the ribbon over the crowned roller so as to center the ribbon on its reels.

6. A method for cleaning and re-inking a printer ribbon as recited in claim 1 wherein the ribbon includes a reflective element proximate each of its ends and further comprising
   - positioning a second source of light adjacent a surface of the moving ribbon;
   - directing a second beam of light from the second source against the moving ribbon;
   - positioning a second light detector proximate the source; and
   - stopping the rotation of said spindles when the light detector senses second light reflected from the reflective element as it passes through the second beam of light.

* * * * *